US005625282A

United States Patent [19]

Kawahara

[11] Patent Number: 5,625,282

[45] Date of Patent: Apr. 29, 1997

[54] CONSTANT CURRENT CIRCUIT FOR PREVENTING LATCH-UP

[75] Inventor: Tadashi Kawahara, Tokyo, Japan

[73] Assignee: Mitsubishi Denki Kabushiki Kaisha, East Hills, N.Y.

[21] Appl. No.: 598,892

[22] Filed: Feb. 9, 1996

[30] Foreign Application Priority Data

Sep. 1, 1995 [JP] Japan ..... 7-225152

[51] Int. Cl.[6] ..... G05F 3/04; G05F 3/08; G05F 3/16; G05F 3/20

[52] U.S. Cl. ..... 323/315; 323/312

[58] Field of Search ..... 323/315, 312, 323/313, 314, 316

[56] References Cited

U.S. PATENT DOCUMENTS 4,792,750 12/1988 Yan ..... 323/315
4,950,976 8/1990 Wagoner ..... 323/315
5,223,743 6/1993 Nakagawara ..... 323/315
5,300,765 4/1994 Mizuta ..... 235/492
5,410,242 4/1995 Bittner ..... 323/315
5,481,180 1/1996 Ryat ..... 323/315
5,521,544 5/1996 Hatanaka ..... 323/315

*Primary Examiner*—Peter S. Wong
*Assistant Examiner*—Bao Q. Vu
*Attorney, Agent, or Firm*—Leydig, Voit & Mayer

[57] ABSTRACT

The present invention provides a constant current circuit for suppressing operation of parasitic thyristor and for preventing short-circuit of IC, even if high voltage such as a thunder is applied to a power source which increases a power supply potential Vcc momentarily. A constant current circuit of the present invention comprises a first current mirror circuit having a first pair of transistors, a second current mirror circuit having a second pair of transistors, and a MOS type capacitor being connected between the collector electrodes of said first pair of transistors and being formed in a second well area of the semiconductor substrate which is adjacent to the first well area where the first and the second mirror circuits are formed thereon.

9 Claims, 9 Drawing Sheets

CONSTANT CURRENT CIRCUIT FOR PREVENTING LATCH-UP

BACKGROUND OF THE INVENTION

1. Field of the Invention

The present invention relates to a constant current circuit. More particularly, the present invention relates to a constant current circuit for preventing latch up generated at a constant current circuit in a PLL synthesizer IC used in a terminal equipment of a wireless telephone.

2. Description of the Prior Art

In order to meet the demand of recent miniaturization of telephone terminal equipment, it is also attempted to miniaturize the semiconductor integrated circuit (IC) built in the telephone terminal equipment. As a result, narrower separation areas between the elements bring about a newly-arising problem of a parasitic thyristor which is formed in an area between the elements and a separation layer, which has not been a serious problem until now. If high voltage generated by, for example, thunder raises the power supply potential Vcc momentarily, this parasitic thyristor in the constant current circuit shorts the IC circuit, which leads to a serious problem.

FIG. 9 shows a location of the constant current circuit built in PLL used for the telephone terminal equipment, for instance. In FIG. 9, the constant current circuit is used in PLL synthesizer IC for supplying current for a charge pump circuit, a phase-comparison circuit, a prescaler circuit and so on.

FIG. 7 shows a conventional constant current circuit. In FIG. 7, the constant current circuit has a capacitor X for preventing oscillation. This capacitor X is connected between a collector electrode an emitter electrode of a transistor Q1. An area 10 circumscribed by a chain line shows a part of an IC circuit including a base, an emitter, a collector of an oscillation transistor Q4 and the capacitor X of the constant current circuit. An area 12 circumscribed by a two-dot chain line shows a parasitic thyristor which is assumed to be formed between a point "a" and a point "d" in the area 10. This parasitic thyristor comprises a PNP parasitic transistor q1 and a NPN parasitic transistor q2. In the parasitic thyristor circuit 12, a resistor r1 is connected between an emitter of the transistor q1 and the point a which is connected to the voltage source Vcc via resistor R2, a resistor r2 is connected between a base of transistor q1 and the point a, a resistor r3 is connected between a base of the transistor q1 and the collector of transistor q1, a resistor r4 is connected between the base of transistor q2 and the point d, and a collector of the transistor q2 is connected to the point d which is connected the ground.

FIG. 8 shows an enlarged view of the thyristor elements actually formed on the IC. The thyristor elements are depicted in FIG. 7 as shown circumscribed by a two-dot chain line. In FIG. 8, a first $N^-$ well area is defined at a plane of substrate (P-sub). In the first $N^-$ well area, an $N^+$ area for base contact, a $P^+$ area for emitter contact, and a $P^+$ area for collector contact are defined. On the other hand, a second $N^-$ well area is defined adjacent to the first $N^-$ well area in the substrate P-sub. Then a dielectric layer is formed on the second $N^-$ well area and then an electrode is formed on the dielectric layer to make the capacitor X.

The emitter electrode of the transistor Q4 is connected to the power supply potential node through a resistor R2, while both the base electrode and the collector electrode are connected to one of electrodes (conductive layer) of the capacitor X formed on the dielectric layer. The other electrode of capacitor X on the second $N^-$ well area is connected to a ground potential node via N area which is formed in the $N^-$ well area. As described above, the constant current circuit is formed on the IC using lateral type of transistors.

FIG. 8 shows only the base, the emitter, the collector and the capacitor X, and the other parts are omitted for simplicity of explanation. In such a construction, when the P-sub separation layer between the first $N^-$ well area and the second $N^-$ well area becomes narrower by miniaturizing the size of IC, a parasitic thyristor comprised of a PNP parasitic transistor q1 and a NPN parasitic transistor q2 are formed through nodes a, b, c and d in the first $N^-$ well area and the second $N^-$ well area in IC. This parasitic thyristor is depicted by the two-dot chain line in FIG. 7 between a power supply potential node and a ground potential node via the resistor R2. In other words, a parasitic thyristor circuit 12 is formed in addition to the usual IC circuit comprised of transistors Q4 and Q1 as shown in FIG. 8.

To explain this parasitic thyristor in detail, a parasitic resistor r1 is connected between an emitter of the parasitic transistor q1 and the emitter layer $P^+$ of transistor Q4 (point a) which is connected to the power supply potential node via the resistor R2. A parasitic resistor r2 is connected between a base of the parasitic transistor q1 and the emitter layer $P^+$ of transistor Q4 (point a). Furthermore, a parasitic resistor r3 is connected between a collector and the base of the parasitic transistor q1. The collector and the base of the parasitic transistor q1 are connected to the base and the collector of the parasitic transistor q2, respectively. A parasitic resistor r4 is connected between a base of the parasitic transistor q2 and the ground potential node. An emitter of the parasitic transistor q2 is grounded directly via the point d and the N layer in the $N^-$ well area.

An operation of the parasitic thyristor is explained below. If the power supply potential Vcc rises momentarily, for example, due to high voltage generated by thunder, this high voltage is applied to the emitter (point a) of the transistor Q4 via the resistor R2, and a current $i_1$ flows from the point a to the ground (point d) via the parasitic resistor r2, parasitic resistor r3, parasitic resistor r4. If the value of the current $i_1$ is large enough to generate a voltage drop through the resistor r2 which is greater than the voltage of the base-emitter voltage $V_{BE}$ (about 0.7 V) of the parasitic transistor q1, and also if the voltage drop through the resistor r4 becomes grater than the voltage of the base-emitter voltage $V_{BE}$ (about 0.7 V) of the parasitic transistor q2, both parasitic transistors q1 and q2 are operated in the ON state. Therefore, the voltage node potential Vcc is shorted 2 to the ground through the parasitic thyristor.

As explained above, in the prior constant current circuit, when a high voltage is applied to the power source potential node by some reasons, the power source potential node is shorted to the ground which makes a serious problem to the constant current circuit.

It is an object of the present invention to provide a constant current circuit having a latch-up prevention measures for preventing the operation of the parasitic thyristor even if the high voltage is applied to the power source potential node.

SUMMARY OF THE INVENTION

According to one aspect of the invention, a constant current circuit comprises a first current mirror circuit having a first pair of first conductive type transistors (Q4, Q3) which is formed in a first well area of a semiconductor substrate, wherein said first pair of transistors have respective emitter electrodes connected to a first power supply potential node; a second current mirror circuit having a second pair of second conductive type transistors (Q1, Q2) formed on a plane of the semiconductor substrate, wherein said second pair of transistors have respective emitter electrodes connected to a second power supply potential node and respective collector electrodes of said second pair of transistors are connected to collector electrodes of corresponding first pair of transistors; and a MOS type capacitor being connected between the collector electrodes of said first pair of transistors and being formed in a second well area of the semiconductor substrate which is adjacent to said first well area.

According to another aspect of the invention, a constant current circuit comprises a first current mirror circuit having a first pair of first conductive type transistors (Q4, Q3) which is formed in a first well area of a semiconductor substrate, wherein said first pair of transistors have respective emitter electrodes connected to a first power supply potential node; a second current mirror circuit having a second pair of second conductive type transistors (Q1, Q2) formed on a plane of the semiconductor substrate, wherein said second pair of transistors have respective emitter electrodes connected to a second power supply potential node via a resistor R and respective collector electrodes of said second pair of transistors are connected to collector electrodes of corresponding first pair of transistors; and a MOS type capacitor being connected between the collector electrodes of said first pair of transistors and being formed in a second well area of the semiconductor substrate which is adjacent to said first well area.

Preferably, a resistor R which is connected to the emitter of the transistor Q1 is formed on a plane of said substrate.

According to still further aspect of the invention, a constant current circuit comprises a current mirror circuit comprised of a first conductive type transistor (Q5) whose base is connected to the base of said transistor (Q4), whose emitter is connected to a first power supply potential node and whose collector supplies a current to an outside circuit.

According to further aspect of the invention, a constant current circuit comprises a current mirror circuit including of a second conductive type transistor (Q8) whose base is connected to the base of said transistor (Q1), whose emitter is connected to a second power supply potential node and whose collector draws a current from an outside circuit.

According to further aspect of the invention, a constant current circuit comprises a pair of third current mirror circuits comprised of first conductive type transistors (Q5, Q6) whose bases are connected to the base of said transistor (Q4), whose both emitters are connected to a first power supply potential node; and a pair of fourth current mirror circuits comprised of second conductive type transistors (Q7, Q8), whose bases are connected each other and the collector of said transistor (Q7) is connected to the collector of the transistor (Q6), whose both emitters are connected to a second power supply potential node; wherein said collector of the transistor (Q5) supplies a current to an outside circuit, and said collector of the transistor (Q8) draws a current from an outside circuit.

DETAILED DESCRIPTION OF THE PREFERRED EMBODIMENTS

Embodiment 1

Figure 1:
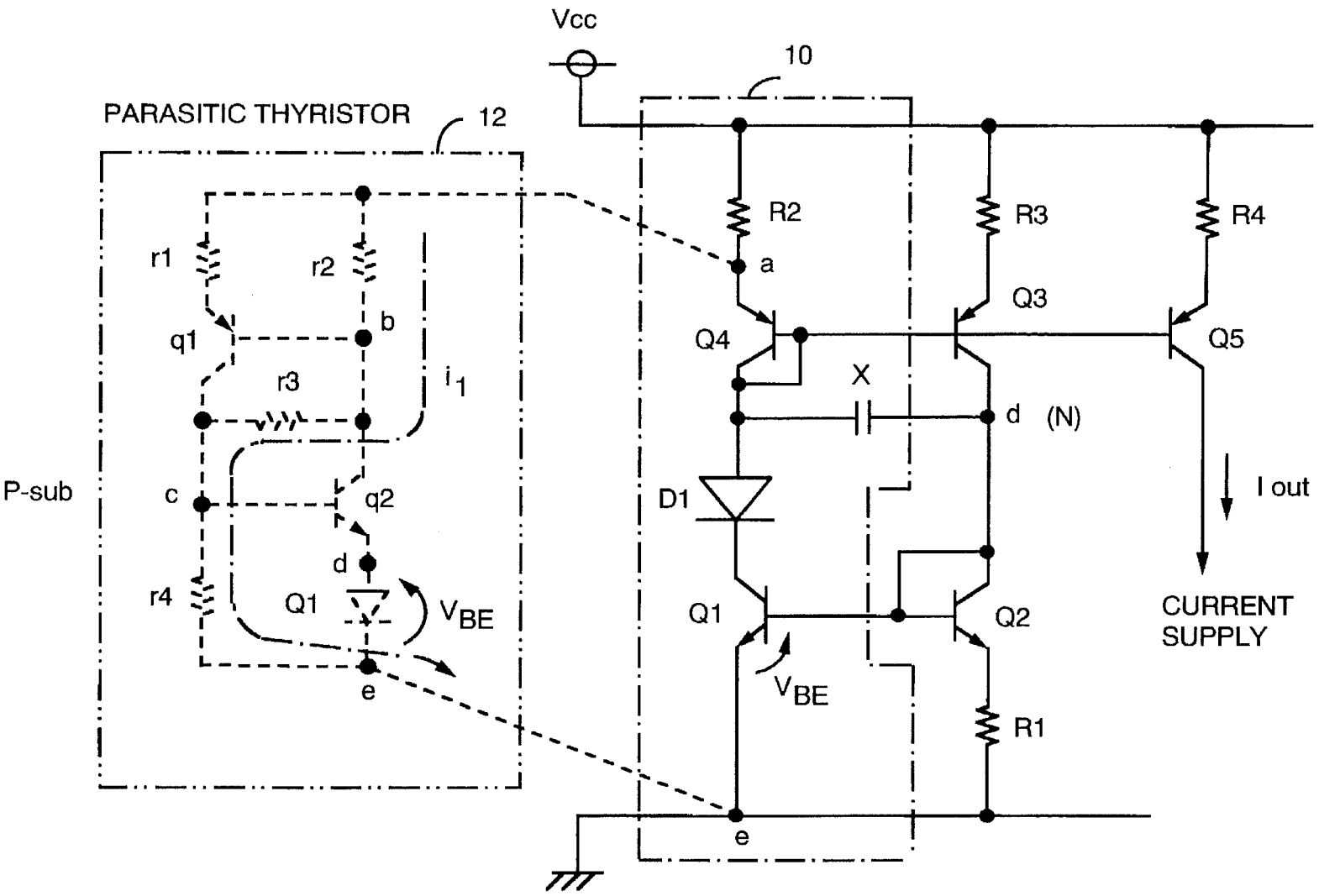
FIG. 1 shows a circuit configuration of a constant current circuit of a first embodiment of the present invention.

The first embodiment of the present invention is explained below using FIG. 1. FIG. 1 shows a circuit configuration of a constant current circuit for preventing latch up of a constant current circuit in a first embodiment of the present invention. In FIG. 1, the constant current circuit comprises a first mirror circuit comprised of transistors Q3 and Q4, a second mirror circuit comprised of transistors Q1 and Q2, a diode D1, a MOS capacitor X which is connected between the collector of transistor Q1 and the collector and base of the transistor Q2. The diode D1 has an anode electrode connected to a collector electrode of transistor Q4, and a cathode electrode connected to a collector electrode of transistor Q1. In the first embodiment, one end of the capacitor X is connected to the collector of the transistor Q4 and the other end is connected to the collector and base of the transistor Q2. This capacitor X is used for preventing oscillation. The elements having the same reference numbers in FIG. 1 as in FIG. 7 are are explained above in connection with FIG. 7. Accordingly the detailed explanation of those elements is not repeated.

Figure 2:
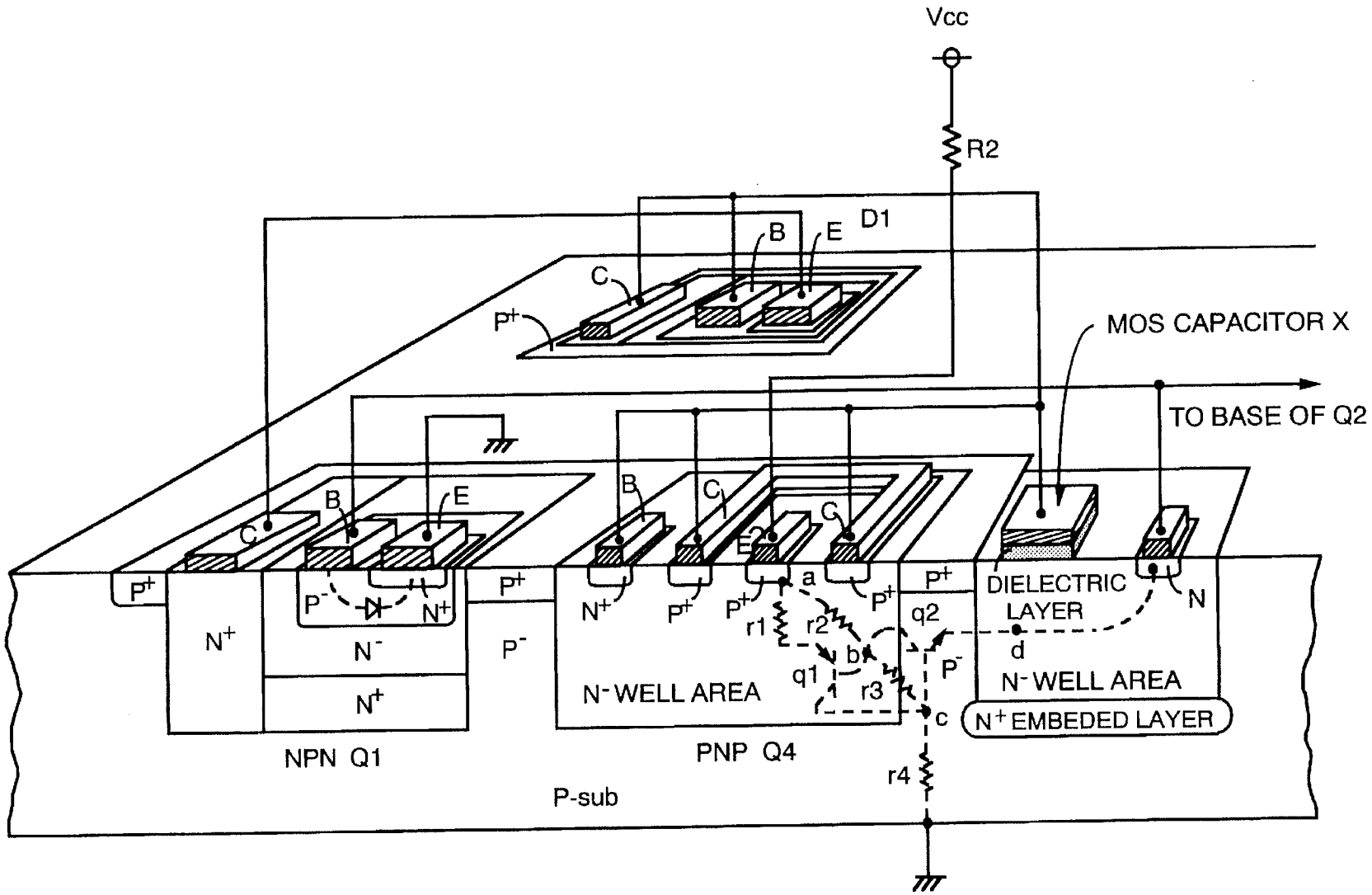
FIG. 2 is an enlarged part of a constant current circuit actually formed on IC, which is circumscribed by a chain line in FIG. 1.

FIG. 2 shows an actual construction of an IC of a constant current circuit in FIG. 1. FIG. 2 shows only the transistor Q4, the diode D1, the transistor Q1, and the capacitor X, which are formed on the substrate as lateral transistor structure, and other parts are omitted for simplicity of explanation. In such a construction, when the P-sub separation layer between the first $N^-$ well area and the second $N^-$ well area becomes smaller by miniaturizing the size of IC, a parasitic thyristor comprised of the a PNP parasitic transistor q1 and a NPN parasitic transistor q2 are formed through nodes a, b, c and d in the first $N^-$ well which significantly influences the operation of the constant current circuit. This parasitic thyristor is depicted by the dotted line in FIG. 1 between a power supply potential node and a ground potential node via the resistor R2. In other words, a parasitic thyristor circuit 12 in FIG. 1 is formed in addition to the usual IC circuit comprised of transistors Q4 and Q1 as shown in FIG. 2.

Figure 8:
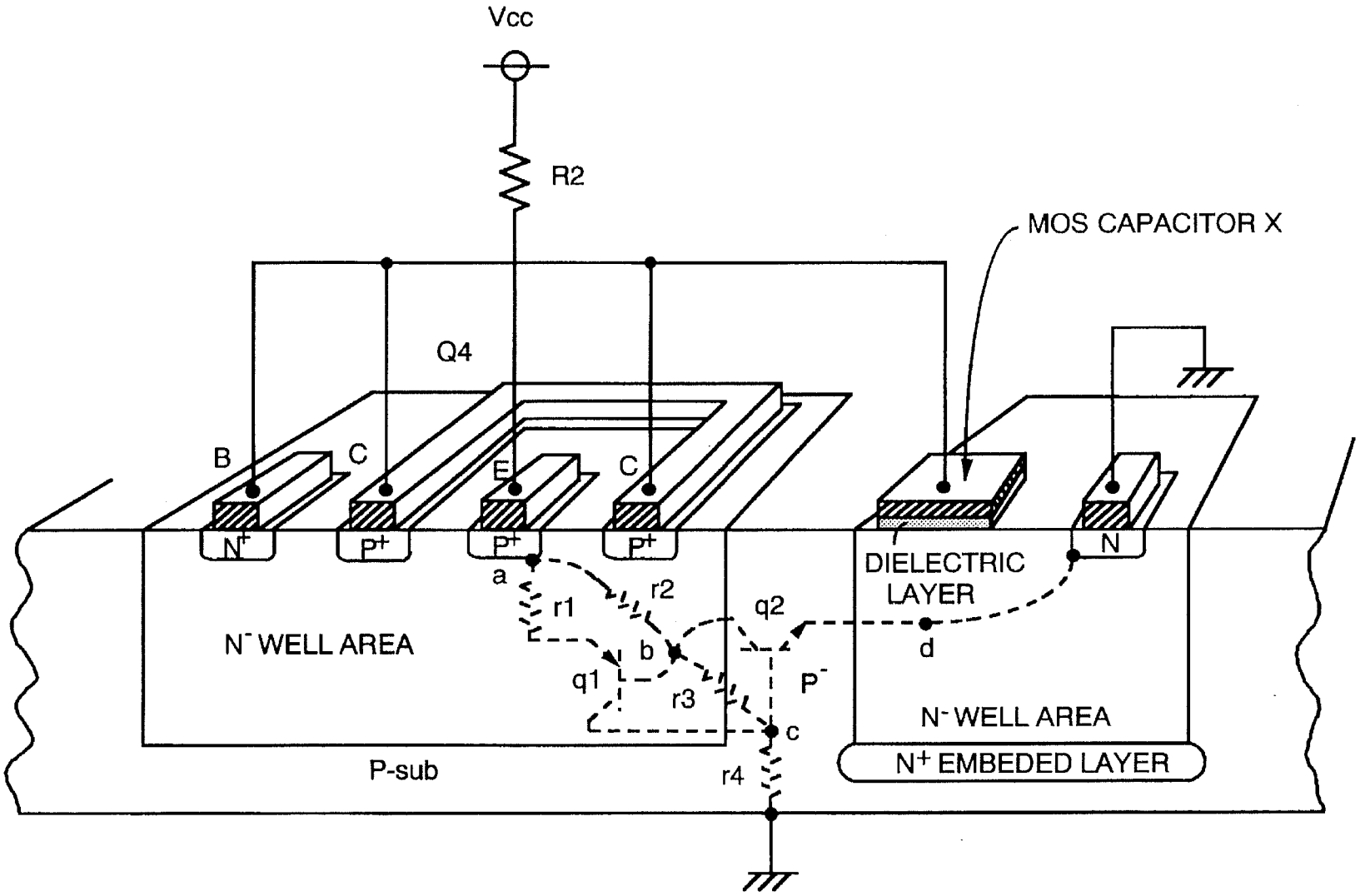
FIG. 8 (PRIOR ART)
FIG. 8 is an enlarged part of a conventional constant current circuit actually formed on IC, which is circumscribed by a chain line in FIG. 7.
Figure 9:
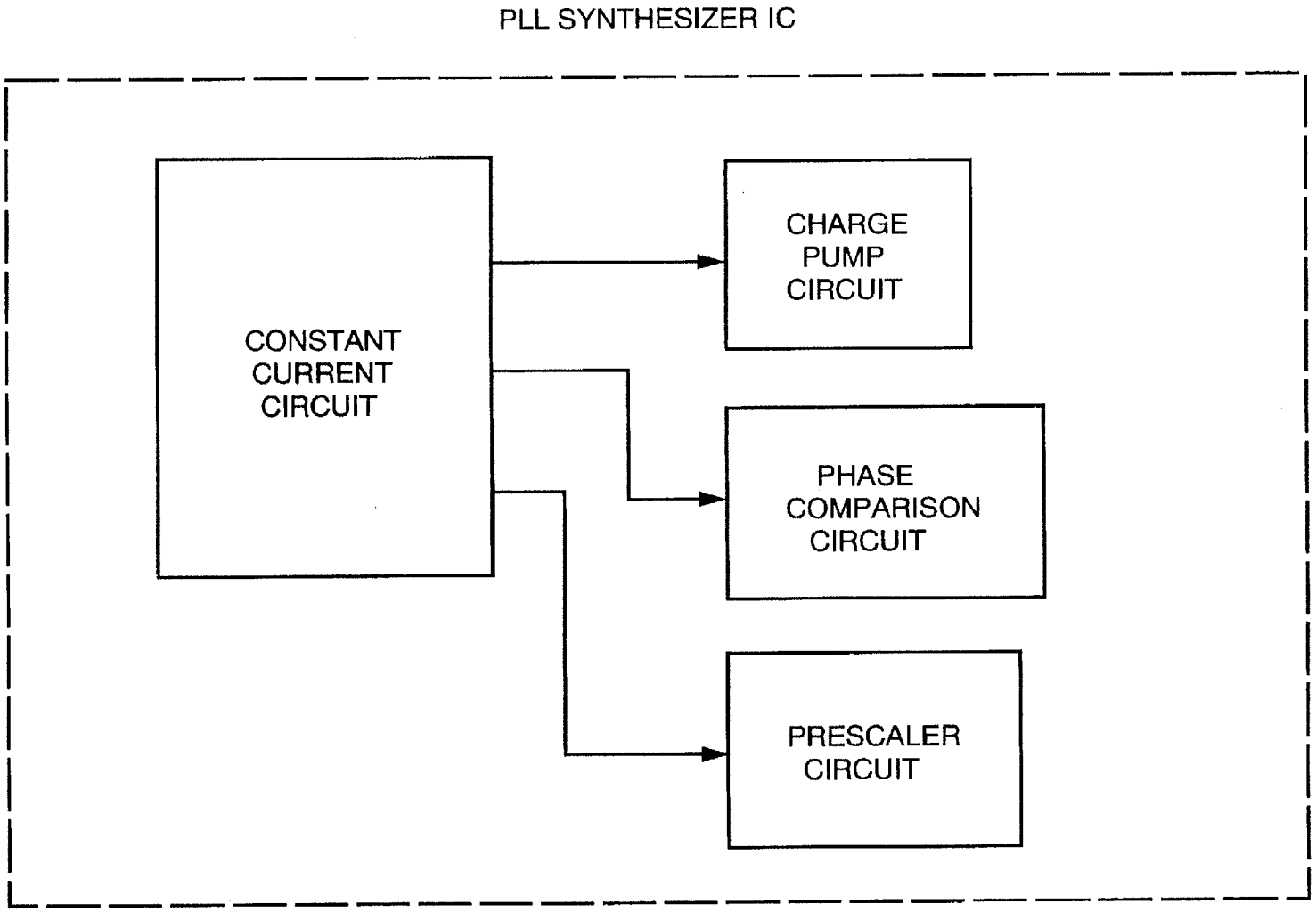
FIG. 9 (PRIOR ART)
FIG. 9 shows a conventional constant current circuit for supplying current to other circuits which are built in PLL synthesizer IC.

Although this parasitic thyristor has a similar construction as that in the prior art in FIG. 8, there is a significant difference from the prior art in that the emitter of parasitic transistor q2 of the parasitic thyristor is grounded directly in the prior art. Alternatively the emitter of parasitic transistor q2 of the parasitic thyristor is grounded via the base-emitter contact of the transistor Q1 in the present invention.

The present embodiment is explained in detail below. A parasitic resistor r1 is connected between an emitter of parasitic transistor q1 and the emitter of the transistor Q4 (node a), while a parasitic resistor r2 is connected between a base of parasitic transistor q1 and the emitter of the transistor Q4 (node a). Furthermore, a parasitic resistor r3 is connected between the collector and the base of the parasitic transistor q1. The collector and the base of parasitic transistor q1 are connected to the base and the collector of parasitic transistor q2, respectively. The base of parasitic transistor q2 is connected to the ground potential node through parasitic resistor r4. The emitter of parasitic transistor q2 is grounded through the base-emitter contact of the transistor Q1.

An operation of this parasitic thyristor is explained below. In case that a power supply potential Vcc experiences a high voltage spike, the high voltage is applied to the point a through R2, and a current $i_1$ flows through the parasitic resistor r2, the parasitic resistor r3, and the parasitic resistor r4. Therefore, voltage drop of parasitic resistor r2 becomes current $i_1$×resistance of resistor r2, while voltage drop of parasitic resistor r4 becomes current $i_1$×resistance of resistor r4.

In FIG. 1, the parasitic transistor q1 turns on on the condition that the voltage drop of the parasitic resistor r2 is larger than $V_{BE}$ of the parasitic transistor q1. The parasitic transistor q2 turns on on the condition that the voltage drop of the parasitic resistor r4 is larger than $2V_{BE}$ (voltage $V_{BE}$ between emitter and base of the parasitic transistor q2+voltage $V_{BE}$ between emitter and base of the transistor Q1). The condition which the parasitic transistor q1 turns on is the same, but the condition which the parasitic transistor q2 turns on is different from that of FIG. 7. That is, since voltage $V_{BE}$ (approximately 0.7 V) between the emitter and base of the transistor Q1 is further applied between the emitter of the parasitic transistor q2 and the ground, it is necessary that the base potential (point c) be higher than $2\times V_{BE}$ in order to cause the parasitic transistor q2 to turn on, which makes it difficult to operate the parasitic thyristor. As described above, in the first embodiment of the present invention, since emitter of the parasitic transistor q2 is grounded via the contact between the base and emitter of the transistor Q1, a constant current circuit is provided wherein the parasitic thyristor hardly causes the latch up.

Embodiment 2

Figure 3:
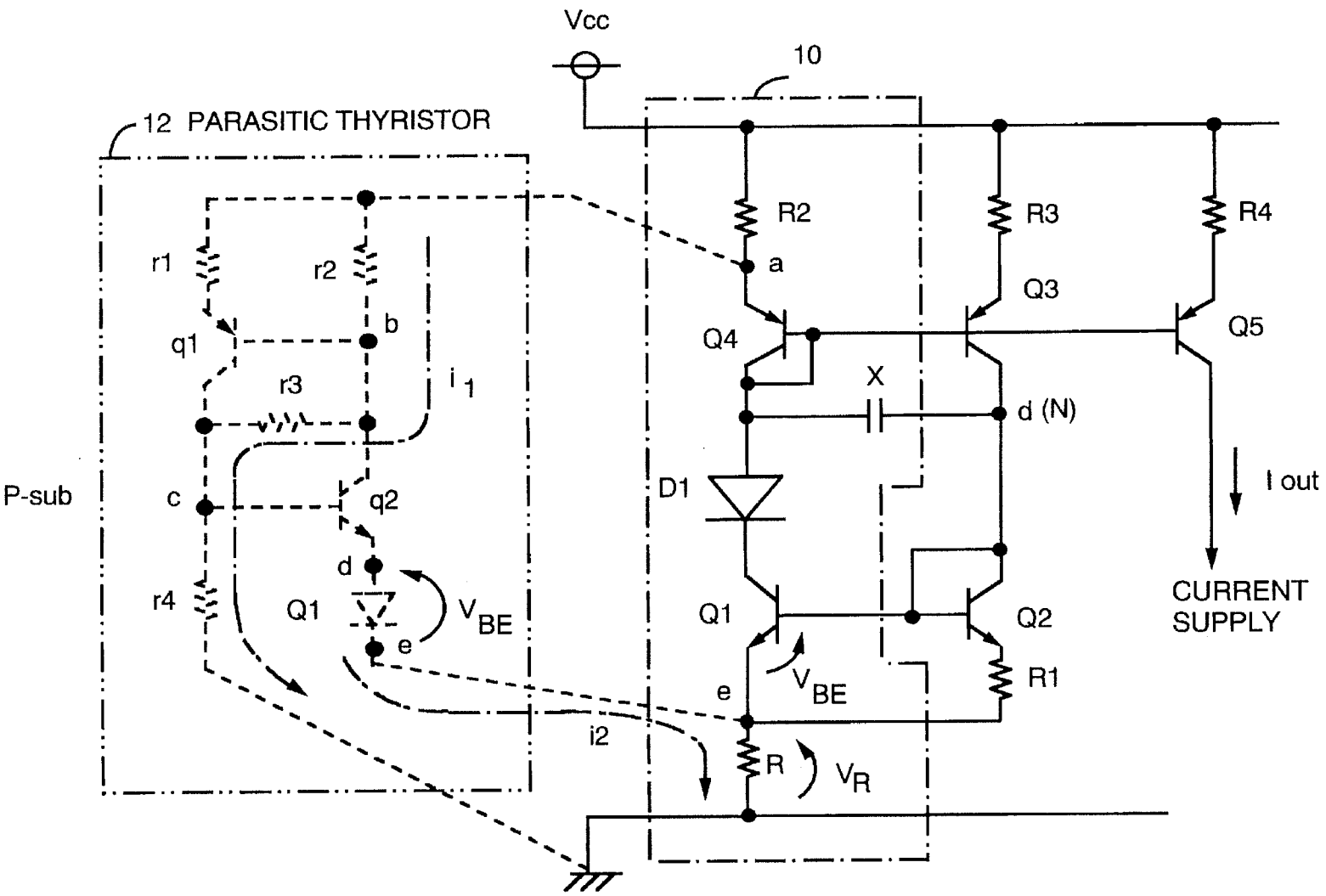
FIG. 3 shows a circuit configuration of a constant current circuit of a second embodiment of the present invention.

FIG. 3 shows a circuit configuration of a constant current circuit for preventing latch up in a second embodiment of the present invention. In FIG. 3, the constant current circuit comprises a transistor Q4, a diode D1 having an anode which is connected to the collector of transistor Q4 and a cathode which is connected to a collector of transistor Q1, a MOS capacitor X which is connected between the collector of transistor Q1 and the collector and base of the transistor Q2, and a resistor R which is connected between an emitter electrode of transistor Q1 and a ground potential node.

A parasitic thyristor is formed in the well area and the P-sub area, where a parasitic resistor r1 is connected between an emitter of the parasitic transistor q1 and the collector of transistor Q4 (point a) which is connected to the power supply potential node via the resistor R2. A parasitic resistor r2 is connected between a base (point b) of the parasitic transistor q1 and collector of transistor Q4 (point a) which is also connected to the power supply potential node via the resistor R2. Furthermore, a parasitic resistor r3 is connected between a collector and the base of the parasitic transistor q1. The collector and the base of the parasitic transistor q1 are connected to the base and the collector of the parasitic transistor q2, respectively. A parasitic resistor r4 is connected between a base of the parasitic transistor q2 and the ground potential node. An emitter of the parasitic transistor q2 is grounded via the base-emitter contact of transistor Q1 and a resistor R. The resistor R also is connected to the emitter of the transistor Q1. The elements having the same reference numbers in FIG. 3 are the same portions or the corresponding portions in FIG. 1. Accordingly the detailed explanation of the same portions is omitted.

Figure 4:
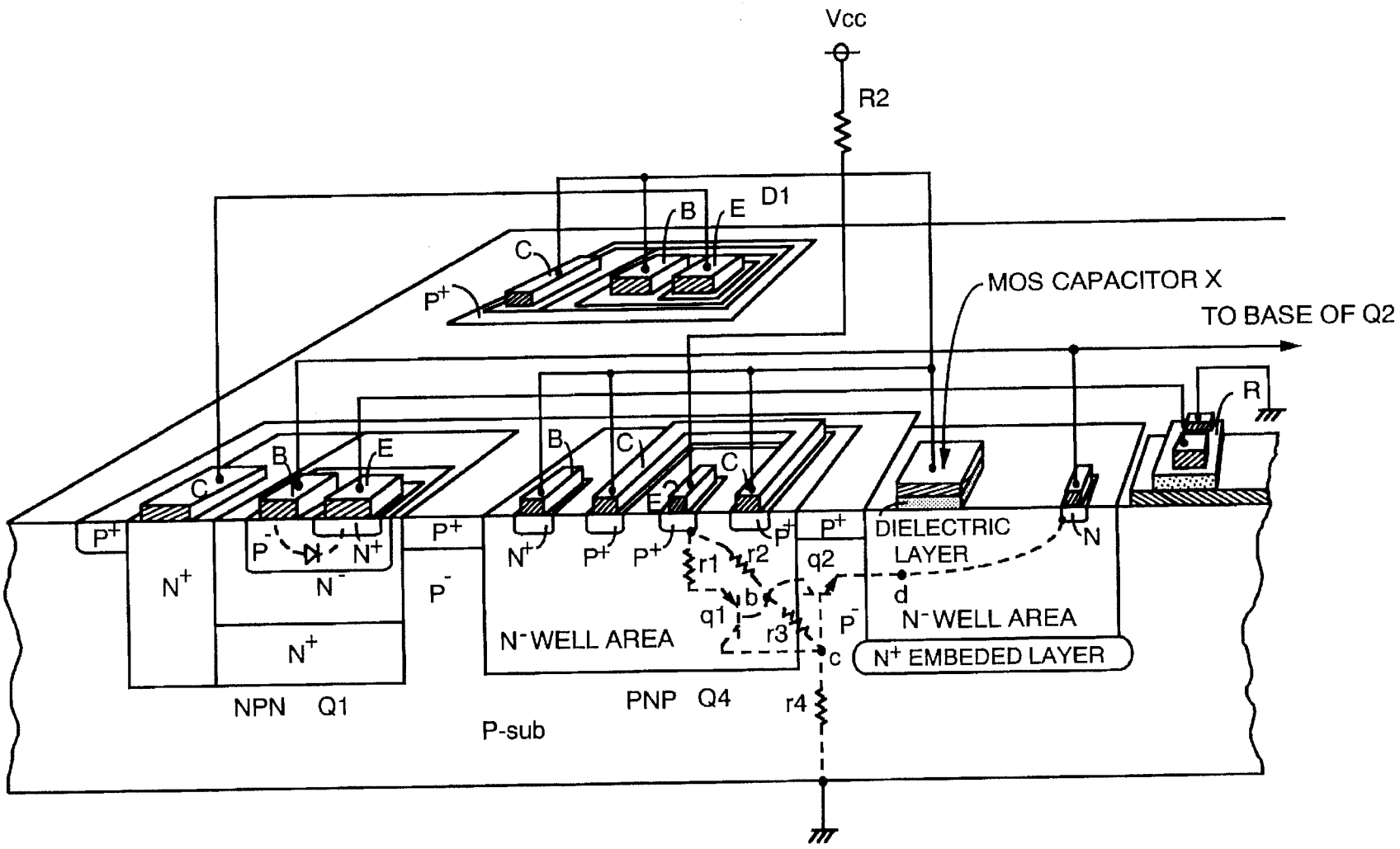
FIG. 4 is an enlarged part of a constant current circuit actually formed on IC, which is circumscribed by a chain line in FIG. 3.

FIG. 4 is an enlarged part of a constant current circuit actually formed on IC, which is circumscribed by a chain line in FIG. 3. In FIG. 4, MOS capacitor X is formed on a second $N^-$ well area which is separated from P-sub by $N^+$ embedded layer, one of its electrodes is formed on a plane side (N in FIG. 3) of substrate, the other is formed on an electric conductive layer which is separated from a substrate by a dielectric layer. This capacitor X is used for preventing oscillation, one of its electrodes is connected to a collective electrode of transistor Q4, the other electrode is connected to a base electrode and a collector electrode of transistor Q2.

In FIG. 4, only transistor Q4, diode D1, transistor Q1, capacitor X and resistor R are shown, and the others are omitted for the simplicity of the explanation. In such a construction, when the P-sub separation layer consisted between the first $N^-$ well area and the second $N^-$ well area becomes smaller by miniaturizing the size of IC, a parasitic thyristor comprised of a PNP parasitic transistor q1 and a NPN parasitic transistor q2 is formed through nodes a, b, c and d in the first $N^-$ well area and the second $N^-$ well area in IC. This parasitic thyristor is depicted by the dotted line in FIG. 3 between a power supply potential node and a ground potential node via the resistor R2. In other words, a parasitic thyristor circuit 12 in FIG. 3 is formed in addition to the usual IC circuit comprised of transistors Q4 and Q1 as shown in FIG. 3.

To explain this parasitic thyristor in detail, a parasitic resistor r1 is connected between an emitter of the parasitic transistor q1 and the emitter layer $P^+$ of transistor Q4 (point a) which is connected to the power supply potential node via the resistor R2. A parasitic resistor r2 is connected between a base of the parasitic transistor q1 and the emitter layer $P^+$ of transistor Q4 (point a) which is connected to the power supply potential node via the resistor R2. Furthermore, a parasitic resistor r3 is connected between a collector and the base of the parasitic transistor q1. The collector and the base of the parasitic transistor q1 are connected to the base and the collector of the parasitic transistor q2, respectively. A parasitic resistor r4 is connected between a base of the parasitic transistor q2 and the ground potential node. An emitter of the parasitic transistor q2 is grounded via the contact between the base and emitter of the transistor Q1 and the resistor R.

An operation of this parasitic thyristor is explained below. In the case a power supply potential Vcc becomes high voltage in a moment as a result of the high voltage caused by the thunder or some other reasons, the high voltage is applied to the point a through R2, and a current $i_1$ flows through the parasitic resistor r2, the parasitic resistor r3, and the parasitic resistor r4. Therefore, voltage drop of parasitic resistor r2 becomes current $i_1$×resistance of resistor r2, while voltage drop of parasitic resistor r4 becomes current $i_1$×resistance of resistor r4.

Figure 7:
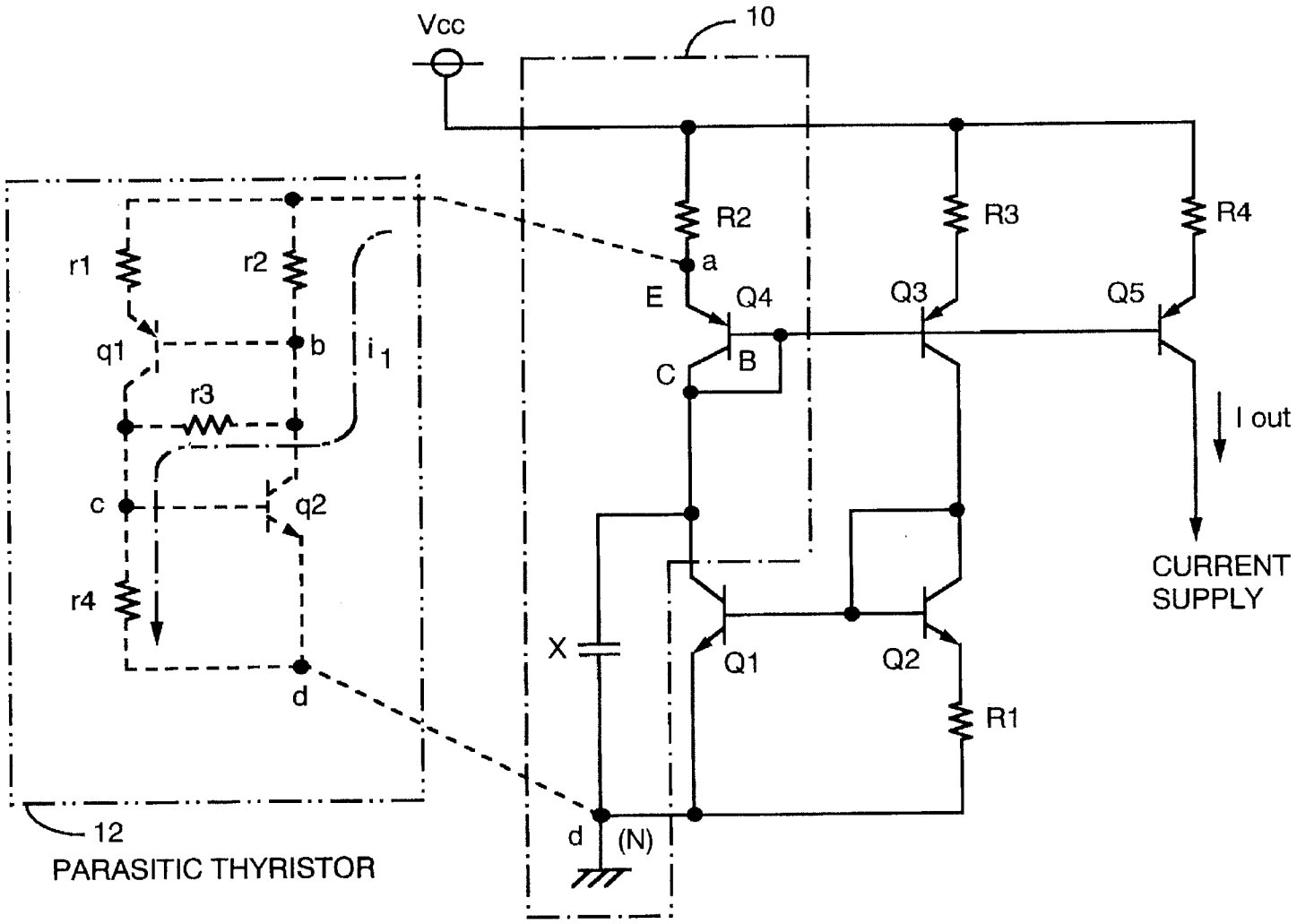
FIG. 7 (PRIOR ART)
FIG. 7 shows a circuit configuration of a conventional constant current circuit.

In FIG. 3, the parasitic transistor q1 turns on on the condition that the voltage drop of the parasitic resistor r2 is larger than $V_{BE}$ of the parasitic transistor q1, which is the same as the description in FIG. 7. The parasitic transistor q2 turns on on the condition that the voltage drop of the parasitic resistor r4 is larger than 2 $V_{BE}$ (voltage $V_{BE}$ between emitter and base of the parasitic transistor q2+voltage $V_{BE}$ between emitter and base of the transistor Q1) plus the voltage drop $V_R$ of the resistor R. Where the voltage drop $V_R$ across the resistor R is current $i_2$×resistance of resistor R. The condition which the parasitic transistor q1 turns on is the same as that of the prior art (FIG. 7), but the condition which the parasitic transistor q2 turns on is different from FIG. 7. That is, since voltage $V_{BE}$ (approximately 0.7 V) between the emitter and base of the transistor Q1 and the voltage drop across the resistor R are further applied between the emitter of the parasitic transistor q2 and the ground, it is necessary that the base potential (point c) be higher than $2\times V_{BE}+V_R$ in order to cause the parasitic transistor q2 to turn on, which makes it more difficult to operate the parasitic thyristor than in the embodiment shown in FIG. 1. As described above, in the second embodiment of the present invention, since emitter of the parasitic transistor q2 is grounded via the contact between the base and emitter of the transistor Q1 and the resistor R, a constant current circuit is provided in which the parasitic thyristor hardly causes the latch up.

Embodiment 3

A third embodiment provides a constant current circuit which comprises transistors Q1~Q4 and further comprises a transistor Q8. The third embodiment provides a constant current circuit for drawing current from outside circuit and for preventing latch up of the constant current circuit.

Figure 5:
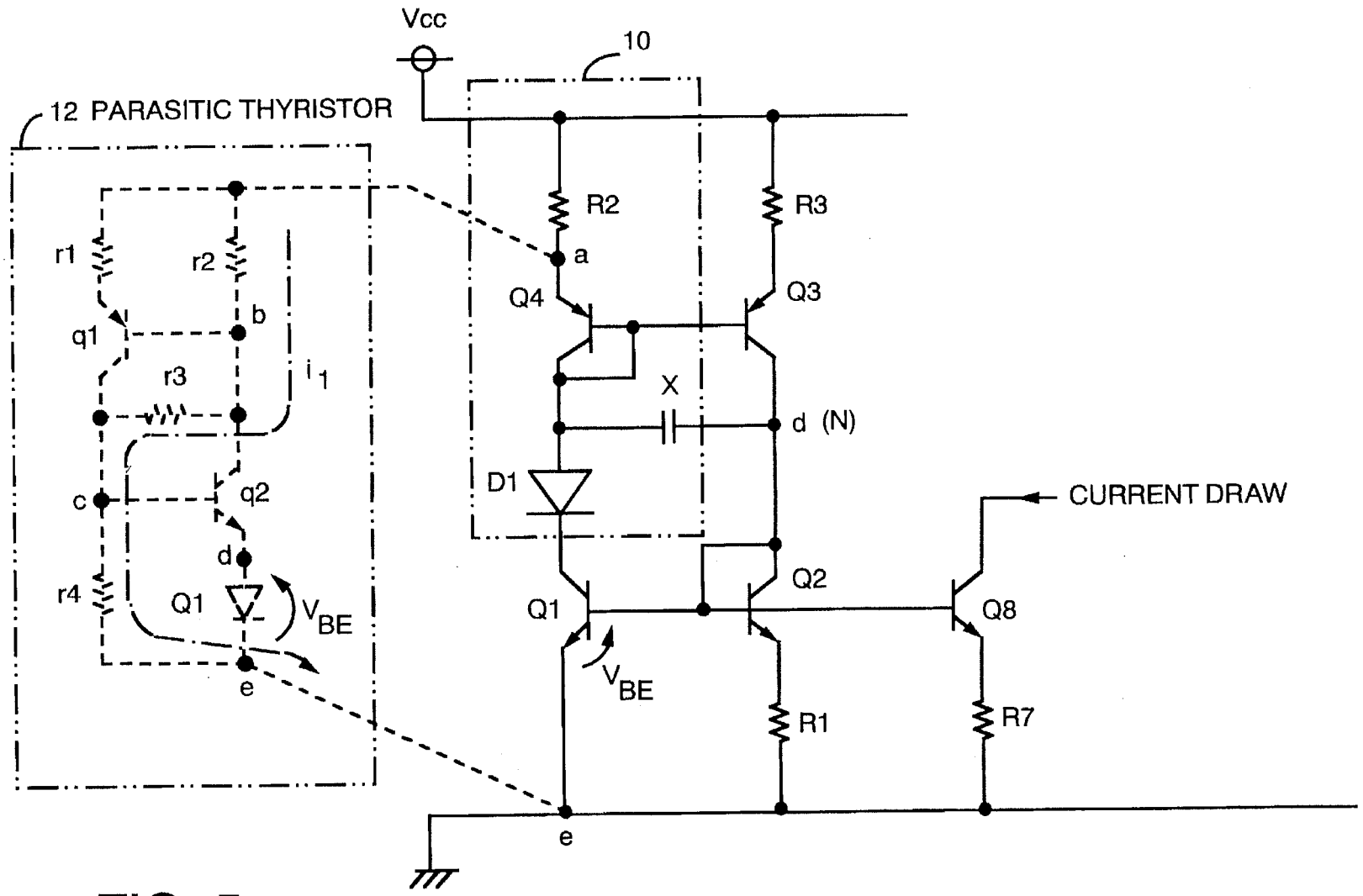
FIG. 5 shows a circuit configuration of a constant current circuit of a third embodiment of the present invention.

FIG. 5 shows a circuit configuration of the constant current circuit for preventing latch up according to the third embodiment of the present invention. The constant current circuit in FIG. 5 comprises a basic circuit shown in FIG. 1 and an additional current mirror circuit. The basic circuit comprises a first pair of PNP transistors (Q4, Q3) and the second pair of NPN transistors (Q1, Q2). The current mirror circuit comprises an NPN transistor Q8, its base is connected to the base of the transistor Q1, and its emitter is connected to the ground potential via a resistor R7. The elements having the same reference numbers in FIG. 5 as in FIG. 1 are explained above in connection with FIG. 1. Accordingly a detailed explanation of those elements is not repeated.

An operation of the third embodiment is explained below. The constant current circuit which comprises the transistors Q1~Q4 and transistor Q8 draws the current from the outside circuit via the collector of the transistor Q8 which is the same current as that of the transistor Q1 by current mirror connection. Such construction prevents the constant current circuit comprised of the transistors Q1~Q4 from stopping in the same way as described in the first embodiment, even in the case that high voltage is applied momentarily to the power supply potential node side. That is, the third constant current circuit draws the current from the outside circuit and also prevents the latch up of the constant current circuit.

Embodiment 4

Figure 6:
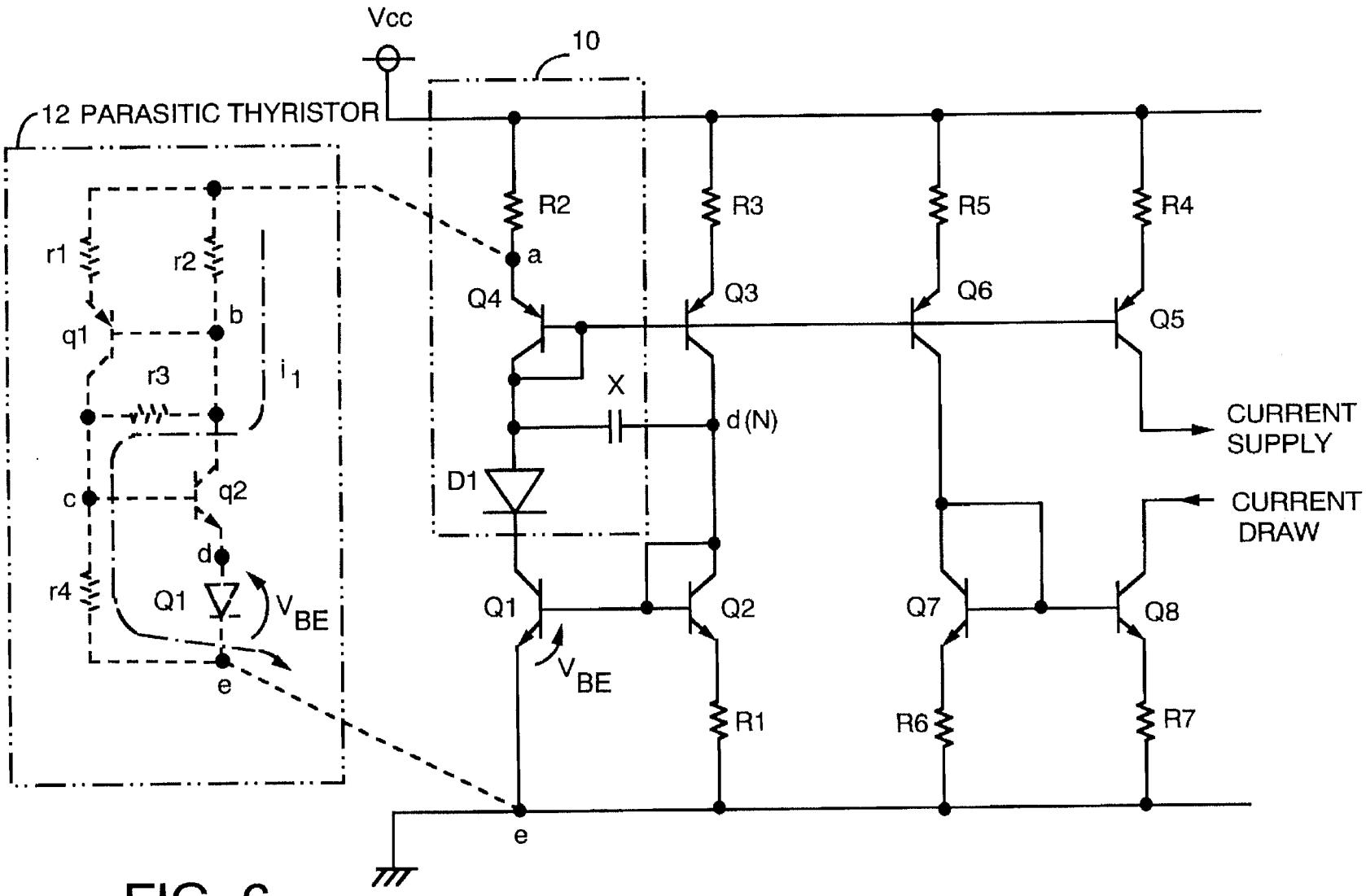
FIG. 6 shows a circuit configuration of a constant current circuit of a fourth embodiment of the present invention.

In a fourth embodiment, the constant current circuit is constructed not only for supplying the current to the outside circuit but also for drawing the current from the outside circuit. The constant current circuit in FIG. 6 comprises a basic circuit and an additional first and second current mirror circuits. The constant current circuit in FIG. 6 comprises a basic circuit in FIG. 1 and an additional first and second current mirror circuits. The basic circuit comprises a first pair of PNP transistors (Q4, Q3) and the second pair of NPN transistors (Q1, Q2). The first additional current mirror circuit comprises an NPN transistors Q5 and Q6 which are current mirrored to the transistor Q4. The second additional current mirror circuit comprises an NPN transistors Q7 and Q8, whose respective currents are the same as that of the transistor Q6.

A base of the transistors Q6 and Q5 are connected to the base of the transistor Q4 and then the currents flowing in the collectors of the transistors Q6 and Q5, respectively, becomes the same as that of the transistor Q4. A collector of the transistor Q6 is connected to a collector of the transistor Q7, and its emitter is connected to the power supply via a resistor R5. An emitter of the transistor Q5 is connected to the power supply via a resistor R4 and its collector supplies a current to the outside circuit. A collector and a base of the transistor Q7 is connected each other and its emitter is connected to the ground potential via a resistor R6. An emitter of the transistor Q8 is connected to the ground potential via a resistor R7 and its collector draws current from the outside circuit.

Such construction prevents the latch-up of the constant current circuit in the same way as explained in the first embodiment, even in the case where a high spike is applied momentarily to the power supply potential node side. That is, the fourth constant current circuit supplies and draws the currents to/from the outside circuit and also prevents the latch up of the constant current circuit. The elements having the same reference numbers in FIG. 6 as in FIG. 1 are explained above in connection with FIG. 1. Accordingly, a detailed explanation of those elements is not repeated.

An operation of the fourth embodiment is explained below. The transistors Q6, Q5 are current mirror connected to the transistor Q4, and the same current as that of transistor Q4 is supplied to the collector of transistor Q5. In the current mirror circuit comprising a pair of transistors Q7, Q8, on the other hand, the collector of the transistor Q7 is connected to the collector of the transistor Q6, and the same current flows through the transistor Q7 as that of the transistor Q6. Since the transistor Q6 is current mirror connected to the transistor Q4, the current which is drawn from the collector of the transistor Q8 is the same as that of the transistor Q4. This construction also prevents the latch up of the constant current circuit.

What is claimed is:

1. A constant current circuit comprising:

a P type semiconductor substrate having a first N type well area and a second N type well area;

first current mirror circuit having:

1) a first PNP type transistor including a collector electrode, an emitter electrode and a base electrode, 2) a power supply potential node, 3) a resistor interconnecting the power supply potential node and the emitter electrode, and 4) a second PNP type transistor having a base electrode connected to the base electrode of the first PNP transistor, a collector electrode and a base electrode;

a diode having an anode electrode connected to the collector electrode of the first PNP type transistor and a cathode electrode;

a second current mirror circuit having:

1) a first NPN type transistor including a collector electrode connected to the cathode electrode of the diode and having an emitter electrode connected to a ground potential node, 2) a second NPN type transistor having a collector electrode connected to the collector electrode of the second PNP type transistor, a base electrode connected to the collector electrode of the second NPN type transistor and to the base electrode of the first NPN type transistor and an emitter electrode, and 3) a third resistor interconnecting the emitter electrode of the second NPN transistor and the ground potential node;

a capacitor having a first electrode disposed on a first N type well area of said P type semiconductor substrate and a second electrode disposed on the first N type well area, the first electrode being connected to the collector electrode of the first PNP type transistor and the second electrode being connected to the collector electrode of the second PNP type transistor; and a drawing terminal disposed on the first N type well area, said drawing terminal being connected to the base of the first NPN type transistor.

2. The constant current circuit of claim 1 wherein: 1) the first and second PNP transistors are disposed on the second N type well area, 2) the first and second NPN type transistors are disposed on said P type semiconductor substrate, 3) said diode is disposed on said P type semiconductor substrate, and 4) the first N type well area is adjacent to the second N type well area.

3. A constant current circuit comprising:

a P type semiconductor substrate having a first N type well area and a second N type well area;

a first current mirror circuit having:

1) a first PNP type transistor including a collector electrode, an emitter electrode and a base electrode, 2) a power supply potential node, 3) a resistor interconnecting the power supply potential node and the emitter electrode, and 4) a second PNP type transistor having a base electrode connected to the base electrode of the first PNP transistor, a collector electrode and a base electrode;

a diode having an anode electrode connected to the collector electrode of the first PNP type transistor and a cathode electrode;

a second current mirror circuit having:

1) a first NPN type transistor including a collector electrode connected to the cathode electrode of the diode and having an emitter electrode connected to a common node, 2) a second NPN type transistor having a collector electrode connected to the collector electrode of the second PNP type transistor, a base electrode connected to the collector electrode of the second NPN type transistor and to the base electrode of the first NPN type transistor and an emitter electrode connected to the common node, and 3) a fourth resistor interconnecting the common node and a ground potential node;

a capacitor having a first electrode disposed on a first N type well area of said P type semiconductor substrate and a second electrode disposed on the first N type well area, the first electrode being connected to the collector electrode of the first PNP type transistor and the second electrode being connected to the collector electrode of the second PNP type transistor; and a drawing terminal disposed on the first N type well area, said drawing terminal being connected to the base of the first NPN type transistor.

4. The constant current circuit of claim 3 wherein 1) the first and second PNP transistors are disposed on the second N type well area, 2) the first and second NPN type transistors are disposed on said P type semiconductor substrate, 3) said diode is disposed on said P type semiconductor substrate, and 4) the first N type well area is adjacent to the second N type well area.

5. The constant current circuit of claim 1 wherein the third resistor is formed on P type semiconductor substrate.

6. The constant current circuit of claim 1 further comprising:

a third current mirror circuit including a third PNP type transistor having a base connected to the base of one of the first and second PNP type transistors, the third PNP type transistor having an emitter connected to a power supply potential node and a collector for supplying a current to an outside circuit.

7. The constant current circuit of claim 3 further comprising:

a third current mirror circuit including a third PNP type transistor having a base connected to a base of one of the first and second PNP type transistors, the third PNP type transistor having an emitter connected to a power supply potential node and a collector for supplying a current to an outside circuit.

8. The constant current circuit of claim 1 further comprising:

a third current mirror circuit including a third NPN type transistor having a base connected to a base of one of the first and second NPN type transistors, the third NPN type transistor having an emitter connected to a ground potential node and a collector for drawing a current from an outside circuit.

9. The constant current circuit of claim 1 further comprising:

a third current mirror circuit including a second pair of PNP type transistors, each one of the second pair of PNP type transistors including a base connected to a base of one of the first pair of PNP type transistors, each of the second pair of PNP type transistors having an emitter connected to a power supply potential node; and a fourth current mirror circuit including a second pair of NPN type transistors, each one of the second pair of NPN type transistors including a base, a collector and an emitter wherein the base of one of the second pair of NPN type transistors is connected to the base of the other one of the second pair of NPN type transistors and the collector of one of the second pair of NPN type transistors is connected to the collector of the other of the second pair of NPN type transistors and the emitters of each one of the second pair of NPN type transistors being connected to a ground potential node;

wherein the collector of one of the second pair of PNP type transistors supplies a current to an outside circuit, and the collector of one of the second pair of NPN type transistors draws a current from an outside circuit.

* * * * *

UNITED STATES PATENT AND TRADEMARK OFFICE

CERTIFICATE OF CORRECTION

PATENT NO. : 5,625,282

DATED : April 29, 1997

INVENTOR(S) : Kawahara

It is certified that error appears in the above-indentified patent and that said Letters Patent is hereby corrected as shown below:

Item 73, Assignee, change "East Hills, NY" to

--Tokyo Japan--.

Signed and Sealed this

Twenty-eighth Day of October, 1997

*Attest:*

Bruce Lehman

BRUCE LEHMAN

*Attesting Officer*

*Commissioner of Patents and Trademarks*